US007611203B1

(12) United States Patent
Roberts et al.

(10) Patent No.: US 7,611,203 B1
(45) Date of Patent: Nov. 3, 2009

(54) PATIENT CHAIR LIFT

(76) Inventors: Cameron B. Roberts, 9 E. Las Palmas Way, Kissimmee, FL (US) 34743; Jerry K. Chang, 8243 118 Ave., N., Largo, FL (US) 33773

( * ) Notice: Subject to any disclaimer, the term of this patent is extended or adjusted under 35 U.S.C. 154(b) by 45 days.

(21) Appl. No.: 11/881,672

(22) Filed: Jul. 27, 2007

(51) Int. Cl.
*A47C 1/00* (2006.01)
*A61G 7/10* (2006.01)

(52) U.S. Cl. ..... 297/344.2; 297/217.7; 5/86.1

(58) Field of Classification Search ..... 297/217.7, 297/DIG. 10, 344.12, 344.18, 344.2; 5/81.1 R, 5/84.1, 86.1, 83.1; 248/405
See application file for complete search history.

(56) References Cited

U.S. PATENT DOCUMENTS 3,981,484 A * 9/1976 James ..... 264/148
4,875,555 A * 10/1989 Johansson et al. ..... 187/226
5,388,289 A * 2/1995 Casperson ..... 5/86.1
5,456,655 A 10/1995 Morris
5,708,993 A 1/1998 Campbell
5,875,501 A 3/1999 Jury
5,996,150 A 12/1999 Blevins
6,694,545 B1 * 2/2004 Renton ..... 5/86.1
6,941,595 B1 * 9/2005 Michael ..... 5/83.1
7,310,833 B2 * 12/2007 Maguire et al. ..... 4/496
7,328,467 B2 * 2/2008 Aarestad ..... 5/83.1
2005/0039256 A1 * 2/2005 Price et al. ..... 5/86.1
2007/0067905 A1 * 3/2007 Wilder ..... 5/83.1

* cited by examiner

*Primary Examiner*—Milton Nelson, Jr.

(57) ABSTRACT

A frame assembly is formed of side rails with a cross rail and spaced vertical support rails. A drive screw is positioned on the cross rail. A motor and a follower are received on the jack screw. The follower may move upwardly and downwardly on the drive screw. A chair has a seat portion and a back portion and is movable between a raised orientation and a lowered orientation on the floor. A separable securement area couples the seat portion with the follower. A control assembly includes an up button and a down button and a stop button.

3 Claims, 2 Drawing Sheets

PATIENT CHAIR LIFT

BACKGROUND OF THE INVENTION

1. Field of the Invention

The present invention relates to a patient chair lift and more particularly pertains to facilitating the lifting and transporting of a patient in a safe, convenient and economical manner.

2. Description of the Prior Art

The use of Patient chair lifts is known in the prior art. More specifically, patient lifting systems of known designs and configurations previously devised and utilized for the purpose of lifting a patient through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,456,655 issued Oct. 10, 1995 to Morris relates to an Ambulatory Support System for Patients. U.S. Pat. No. 5,708,993 issued Jan. 20, 1998 to Campbell relates to a Patient Transporter and Method of Using It. U.S. Pat. No. 5,875,501 issued Mar. 2, 1999 to Jury relates to a Patient Lift. Lastly, U.S. Pat. No. 5,996,150 issued Dec. 7, 1999 to Blevins relates to a Cantilevered Mobile Bed/Chair Apparatus for Safety Patient Transfer.

While these devices fulfill their respective, particular objectives and requirements, the aforementioned patents do not describe a patient chair lift that allows for facilitating the lifting and transporting of a patient in a safe, convenient and economical manner.

In this respect, the patient chair lift according to the present invention substantially departs from the conventional concepts and designs of the prior art, and in doing so provides an apparatus primarily developed for the purpose of facilitating the lifting and transporting of a patient in a safe, convenient and economical manner.

Therefore, it can be appreciated that there exists a continuing need for a new and improved patient chair lift which can be used for facilitating the lifting and transporting of a patient in a safe, convenient and economical manner. In this regard, the present invention substantially fulfills this need.

SUMMARY OF THE INVENTION

In view of the foregoing disadvantages inherent in the known types of patient lifting systems of known designs and configurations now present in the prior art, the present invention provides an improved patient chair lift. As such, the general purpose of the present invention, which will be described subsequently in greater detail, is to provide a new and improved patient chair lift and method which has all the advantages of the prior art and none of the disadvantages.

To attain this, the present invention essentially comprises a patient chair lift. First provided is a frame assembly. The frame assembly is formed of laterally spaced horizontal side rails. The side rails have front ends. The side rails have rear ends. A horizontal cross rail is provided. The cross rail spans the side rails. The frame assembly includes wheels. The wheels are secured beneath the front ends and rear ends of the side rails positioned on a floor. The cross rail is closer to the rear ends than to the front ends. In this manner an enlarged reception area is formed forwardly of the cross rail. The frame also includes laterally spaced vertical support rails. The support rails extend upwardly from the cross rail.

A drive assembly is provided. The drive assembly is formed of a vertically oriented drive screw. The drive screw is positioned on the cross rail midway between the vertical support rails. The drive screw is mounted for rotation upon its axis. The drive assembly includes a motor. The motor is mounted on the cross rail. The motor has gears. The gears drivingly coupling the motor and the drive screw. The drive assembly includes a follower. The follower is threadedly received on the jack screw. In this manner the follower may move upwardly and downwardly on the drive screw upon the rotation in a first direction and counter-rotation in a second opposite direction of the drive screw.

A chair is provided next. The chair has a seat portion. The chair has a back portion. The back portion is positioned adjacent to the vertical rails. The seat portion is movable between a lowered orientation and a raised orientation. The seat portion is positioned in the reception area on the floor when in a lowered orientation. The seat portion is positioned above the floor when in a raised orientation. The seat portion has an angled ramp section. The angled ramp section is provided remote from the back portion. A forward part of the angled ramp section is positioned on the floor when the chair is in the lowered orientation. The rearward part of the angled ramp section is positioned above the floor. In this manner a patient moving onto the seat portion is facilitated.

Provided next is a separable securement assembly. The separable securement assembly includes laterally spaced vertical frame plates. The separable securement assembly includes horizontal upper pins and parallel lower pins. All of the pins are in a common vertical plane. The separable securement assembly includes intermediate members. The intermediate members couple the vertical frame plates with the follower. The separable securement assembly also includes laterally spaced vertical chair plates. The chair plates are secured to the back portion of the chair. The chair plates extend rearwardly from the back portion of the chair. The chair plates have lower slots. The lower slots receive the lower pins. The lower slots are essentially linear and essentially horizontal. The chair plates have upper slots. The upper slots receive the upper pins. The upper slots are in an essentially inverted L-shaped configuration.

Further provided is a control assembly. The control assembly includes an up button. The up button rotates the drive screw in a first direction. In this manner the chair and a patient are lifted at a slow speed. The control assembly includes a down button. The down button rotates the drive screw in a second reverse direction. In this manner the chair and a patient are lowered at a slow speed. The control assembly further includes a stop button. The stop button terminates the rotation of the drive screw. In this manner the movement of the chair and a patient are terminated.

Provided last is a retention assembly. The retention assembly includes an inverted L-shaped brace. The inverted L-shaped brace has a lower end. The lower end is coupled to the intermediate members. The inverted L-shaped brace has an upper end. The inverted L-shaped brace has a hook. In this manner straps are adapted to be employed to provide additional support to a patient on the chair. The retention member is secured for movement with the intermediate member. In this manner the hook remains at a fixed distance from the chair and a patient.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved patient chair lift which has all of the advantages of the prior art patient lifting systems of known designs and configurations and none of the disadvantages.

It is another object of the present invention to provide a new and improved patient chair lift which may be easily and efficiently manufactured and marketed.

It is further object of the present invention to provide a new and improved patient chair lift which is of durable and reliable constructions.

An even further object of the present invention is to provide a new and improved patient chair lift which is susceptible of a low cost of manufacture with regard to both materials and labor, and which accordingly is then susceptible of low prices of sale to the consuming public, thereby making such patient chair lift economically available to the buying public.

Even still another object of the present invention is to provide a patient chair lift for facilitating the lifting and transporting of a patient in a safe, convenient and economical manner.

Lastly, it is an object of the present invention to provide a new and improved patient chair lift. A frame assembly is formed of side rails with a cross rail and spaced vertical support rails. A drive screw is positioned on the cross rail. A motor and a follower are received on the jack screw. In this manner the follower may move upwardly and downwardly on the drive screw. A chair has a seat portion and a back portion. The chair is movable between a raised orientation and a lowered orientation on the floor. A separable securement area couples the seat portion with the follower. A control assembly includes an up button and a down button and a stop button.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
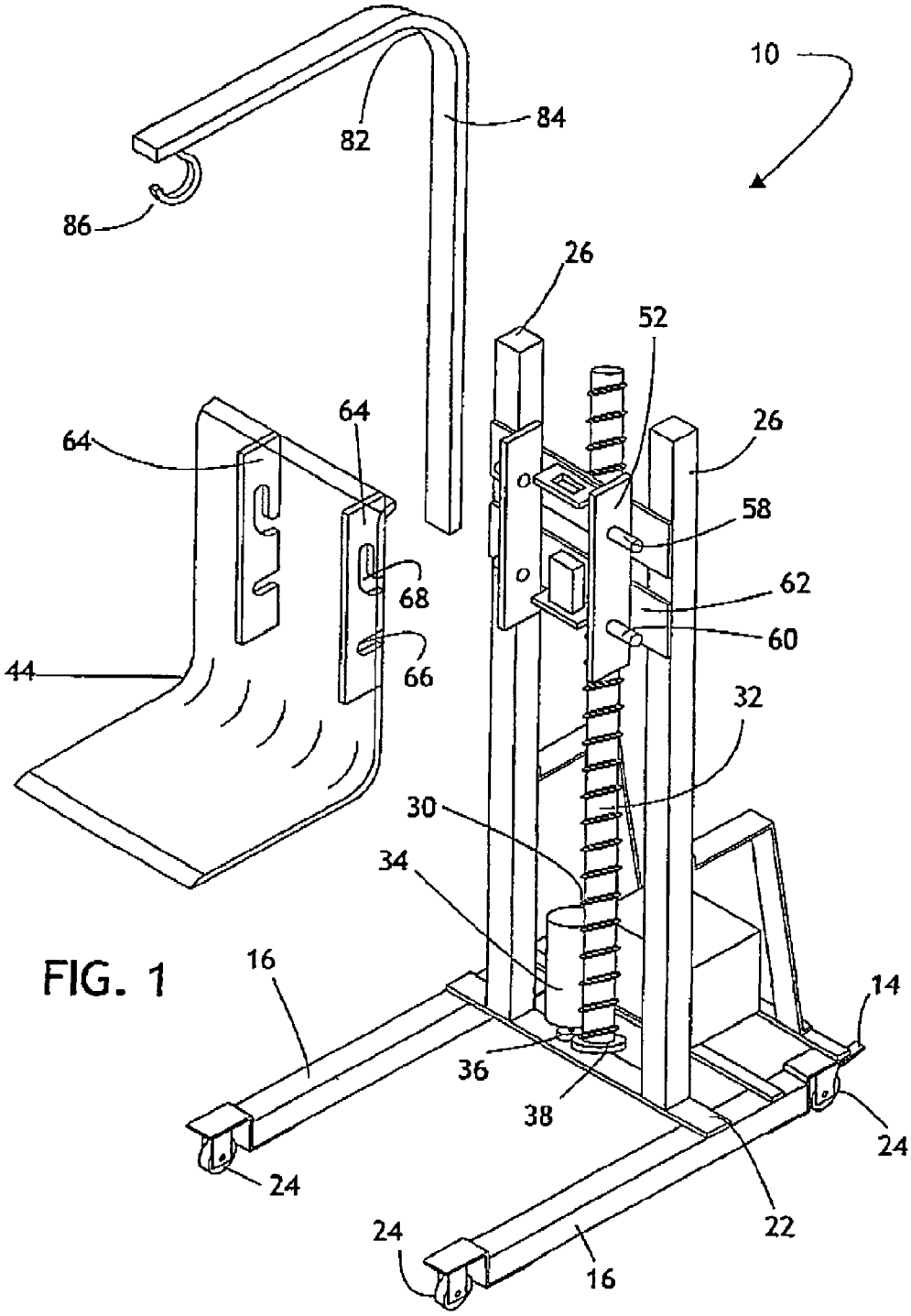
FIG. 1 is an exploded perspective illustration of a patient chair lift constructed in accordance with the principles of the present invention.
Figure 2:
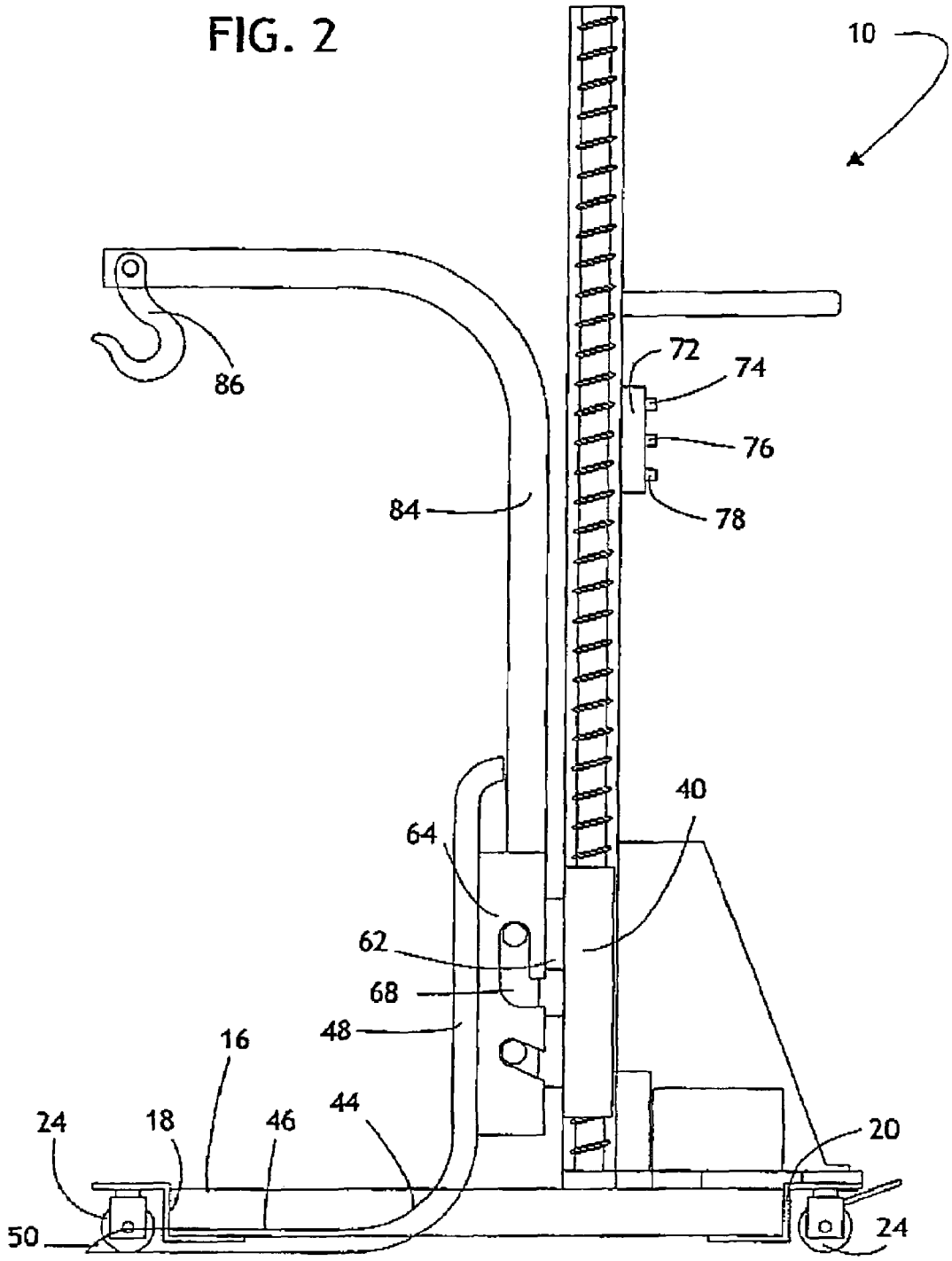
FIG. 2 is a side elevational view of the patient chair lift shown in FIG. 1.

With reference now to the drawings, and in particular to FIG. 1 thereof, the preferred embodiment of the new and improved patient chair lift embodying the principles and concepts of the present invention and generally designated by the reference numeral 10 will be described.

The present invention, the patient chair lift 10 is comprised of a plurality of components. Such components in their broadest context include a frame assembly, a drive screw, a chair, a separable securement area and a control assembly. Such components are individually configured and correlated with respect to each other so as to attain the desired objective.

First provided is a frame assembly 14. The frame assembly is formed of laterally spaced horizontal side rails 16. The side rails have front ends 18. The side rails have rear ends 20. A horizontal cross rail 22 is provided. The cross rail spans the side rails. The frame assembly includes wheels 24. The wheels are secured beneath the front ends and rear ends of the side rails positioned on a floor. The cross rail is closer to the rear ends than to the front ends. In this manner an enlarged reception area is formed forwardly of the cross rail. The frame also includes laterally spaced vertical support rails 26. The support rails extend upwardly from the cross rail.

A drive assembly 30 is provided. The drive assembly is formed of a vertically oriented drive screw 32. The drive screw is positioned on the cross rail midway between the vertical support rails. The drive screw is mounted for rotation upon its axis. The drive assembly includes a motor 34. The motor is mounted on the cross rail. The motor has gears 36, 38. The gears drivingly coupling the motor and the drive screw. The drive assembly includes a follower 40. The follower is threadedly received on the jack screw. In this manner the follower may move upwardly and downwardly on the drive screw upon the rotation in a first direction and counter-rotation in a second opposite direction of the drive screw.

A chair 44 is provided next. The chair has a seat portion 46. The chair has a back portion 48. The back portion is positioned adjacent to the vertical rails. The seat portion is movable between a lowered orientation and a raised orientation. The seat portion is positioned in the reception area on the floor when in a lowered orientation. The seat portion is positioned above the floor when in a raised orientation. The seat portion has an angled ramp section 50. The angled ramp section is provided remote from the back portion. A forward part of the angled ramp section is positioned on the floor when the chair is in the lowered orientation. The rearward part of the angled ramp section is positioned above the floor. In this manner a patient moving onto the seat portion is facilitated.

Provided next is a separable securement assembly. The separable securement assembly includes laterally spaced vertical frame plates 52. The separable securement assembly includes horizontal upper pins 58 and parallel lower pins 60. All of the pins are in a common vertical plane. The separable securement assembly includes intermediate members 62. The intermediate members couple the vertical frame plates with the follower. The separable securement assembly also includes laterally spaced vertical chair plates 64. The chair plates are secured to the back portion of the chair. The chair plates extend rearwardly from the back portion of the chair. The chair plates have lower slots 66. The lower slots receive the lower pins. The lower slots are essentially linear and essentially horizontal. The chair plates have upper slots 68. The upper slots receive the upper pins. The upper slots are in an essentially inverted L-shaped configuration.

Further provided is a control assembly 72. The control assembly includes an up button 74. The up button rotates the drive screw in a first direction. In this manner the chair and a patient are lifted at a slow speed. The control assembly includes a down button 76. The down button rotates the drive screw in a second reverse direction. In this manner the chair and a patient are lowered at a slow speed. The control assembly further includes a stop button 78. The stop button terminates the rotation of the drive screw. In this manner the movement of the chair and a patient are terminated.

Provided last is a retention assembly 82. The retention assembly includes an inverted L-shaped brace 84. The inverted L-shaped brace has a lower end. The lower end is coupled to the intermediate members. The inverted L-shaped brace has an upper end. The inverted L-shaped brace has a hook 86. In this manner straps are adapted to be employed to provide additional support to a patient on the chair. The retention member is secured for movement with the intermediate member. In this manner the hook remains at a fixed distance from the chair and a patient.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A patient chair lift system comprising:

a frame assembly formed of side rails with a cross rail and spaced vertical support rails;

a drive screw positioned on the cross rail with a motor and with a follower received on the drive screw to move upwardly and downwardly on the drive screw;

a chair with a seat portion and a back portion movable between a raised orientation and a lowered orientation adapted to be positioned on a floor;

a separable securement area coupling the seat portion with the follower wherein the separable securement area includes laterally spaced vertical frame plates with horizontal upper pins and parallel lower pins, all of the pins being in a common vertical plane, intermediate members coupling the vertical frame plates with the follower, the separable securement area also including laterally spaced vertical chair plates secured to the back portion of the chair and extending rearwardly there from, the chair plates having lower slots for receiving the lower pins, the lower slots being essentially linear and essentially horizontal, the chair plates having upper slots for receiving the upper pins, the upper slots being in an essentially inverted L-shaped configuration; and a control assembly including an up button and a down button and a stop button.

2. A patient chair lift system comprising:

a frame assembly formed of side rails with a cross rail and spaced vertical support rails;

a drive screw positioned on the cross rail with a motor and with a follower received on the drive screw to move upwardly and downwardly on the drive screw;

a chair with a seat portion and a back portion movable between a raised orientation and a lowered orientation adapted to be positioned on a floor;

a separable securement area coupling the seat portion with the follower; and a retention assembly including an inverted L-shaped brace with a lower end coupled to intermediate members, an upper end having a hook whereby straps are adapted to be employed to provide additional support to a patient when on the chair, the retention assembly being secured for movement with the intermediate member whereby the hook remains at a fixed distance from the chair and a patient.

3. A patient chair lift for facilitating the lifting and transportation of a patient in a safe, convenient and economical manner comprising, in combination:

a frame assembly formed of laterally spaced horizontal side rails having front ends and rear ends with a horizontal cross rail spanning the side rails, wheels secured beneath the front ends and rear ends of the side rails adapted to be positioned on a floor, the cross rail being closer to the rear ends than to the front ends to form an enlarged reception area forwardly of the cross rail, the frame assembly also including laterally spaced vertical support rails extending upwardly from the cross rail;

a drive assembly formed of a vertically oriented drive screw positioned on the cross rail midway between the vertical support rails and mounted for rotation upon its axis, a motor mounted on the cross rail with gears drivingly coupling the motor and the drive screw, a follower threadedly received on the drive screw to move upwardly and downwardly on the drive screw upon the rotation in a first direction and counter-rotation in a second opposite direction of the drive screw;

a chair with a seat portion and a back portion, the back portion positioned adjacent to the vertical rails and the seat portion movable between a lowered orientation and a raised orientation, the seat portion adapted to be positioned in the reception area on the floor when in a lowered orientation, the seat portion adapted to be positioned above the floor when in a raised orientation, the seat portion having an angled ramp section remote from the back portion with a forward part adapted to be on the floor when the chair is in the lowered orientation, the angled ramp section having a rearward part adapted to be above the floor to facilitate a patient moving onto the seat portion;

a separable securement assembly including laterally spaced vertical frame plates with horizontal upper pins and parallel lower pins, all of the pins being in a common vertical plane, intermediate members coupling the vertical frame plates with the follower, the separable securement assembly also including laterally spaced vertical chair plates secured to the back portion of the chair and extending rearwardly there from, the chair plates having lower slots for receiving the lower pins, the lower slots being essentially linear and essentially horizontal, the chair plates having upper slots for receiving the upper pins, the upper slots being in an essentially inverted L-shaped configuration;

a control assembly including an up button to rotate the drive screw in a first direction to lift the chair and a patient at a slow speed and a down button to rotate the drive screw in a second reverse direction to lower the chair and a patient at a slow speed and a stop button to terminate the rotation of the drive screw and the movement of the chair and a patient; and a retention assembly including an inverted L-shaped brace having a lower end coupled to the intermediate members, the upper end having a hook whereby straps are adapted to be employed to provide additional support to a patient when on the chair, the retention assembly being secured for movement with the intermediate member whereby the hook remains at a fixed distance from the chair and a patient.

* * * * *